US005431177A

United States Patent [19]

Kecman

[11] Patent Number: 5,431,177

[45] Date of Patent: Jul. 11, 1995

[54] COMPACT HAVING A WINDOW

[75] Inventor: Michael M. Kecman, Milwaukee, Wis.

[73] Assignee: Sussex Plastics Inc., Sussex, Wis.

[21] Appl. No.: 148,200

[22] Filed: Nov. 3, 1993

[51] Int. Cl.[6] ..... A45D 33/00

[52] U.S. Cl. ..... 132/303; 132/301; 206/581

[58] Field of Search ..... D28/83; 132/291, 293, 132/298, 301, 303, 304, 305; 206/581, 458

[56] References Cited

U.S. PATENT DOCUMENTS

| | | | |
|---|---|---|---|
| D. 303,583 | 9/1989 | Bakic | D28/83 |
| 1,596,499 | 8/1926 | Marcus | 132/303 |
| 1,747,318 | 2/1930 | Pennock | 206/823 |
| 1,786,743 | 4/1929 | Feybusch | 206/823 |
| 1,945,792 | 2/1934 | Stephens | 132/301 |
| 2,158,099 | 5/1939 | Aitken | 132/301 |
| 2,161,715 | 12/1937 | MacDonald | 220/662 |
| 2,549,681 | 4/1951 | Goldstaub . | |
| 3,851,655 | 12/1974 | Tarro | 132/83 |
| 3,911,936 | 10/1975 | Kingsford | 132/79 R |
| 4,388,935 | 6/1983 | Napolitane | 132/83 R |
| 4,684,017 | 8/1987 | Watanabe et al. | 206/235 |
| 4,786,534 | 11/1988 | Aiken | 428/34.2 |
| 5,031,647 | 7/1991 | Seidler | 132/320 |
| 5,105,941 | 4/1992 | Dolan et al. | 206/232 |
| 5,161,556 | 11/1992 | Audebourg et al. | 132/301 |
| 5,246,133 | 9/1993 | James | 220/377 |

*Primary Examiner*—John G. Weiss
*Attorney, Agent, or Firm*—Foley & Lardner

[57] ABSTRACT

The present invention relates to a case, particularly a compact, for storing a cosmetic or other colored substance. The case includes a container for holding the cosmetic and a lid pivotally secured to one side of the container by a hinge. The improvement comprises a window provided in the container through which the cosmetic can be viewed when the case is in a closed position. This permits a makeup mirror or other visual obstruction to be located between the cosmetic and the innerside of the lid. In a preferred form of the invention, the window is an aperture in the flat bottom surface of the container, and the makeup is stored in a transparent pan that overlies or fits into the aperture. Viewing the makeup when the case or compact is closed is advantageous because less display space is necessary to adequately show the makeup case and the packaging required to display the compact is reduced.

24 Claims, 4 Drawing Sheets

COMPACT HAVING A WINDOW

FIELD OF THE INVENTION

The present invention relates to a makeup case or cosmetic compact. More particularly, the present invention relates to a compact for holding makeup which allows the makeup to be seen when the compact is closed.

BACKGROUND OF THE INVENTION

Compacts hold makeup or cosmetics, such as powders, creams, lotions, eye shadow, lipstick, eyeliner, or other beauty aides. Makeup is available in a large variety of colors and textures. Compacts often provide a mirror to allow the users to view themselves as they apply makeup to their face.

A compact includes a lid section and a container section linked together by a hinge. The lid section and container section may be closed upon each other about the hinge so that the compact provides a convenient storage device. A mirror is generally located on the underside of the lid section.

The container section generally includes a metal pan which contains makeup. The compact allows for a pad, brush or other application device to be located between the makeup and lid when the compact is closed. Users apply makeup by rubbing or dipping the pad in the pan which holds the makeup. The pad is used to transfer the makeup to the user.

Compacts are enclosed in packages to prevent product tampering and displayed in stores on shelves or other display areas. Packages add to cost and increase waste associated with the compact.

Compact sellers attempt to display as many compacts as possible in a display area, which is a valuable limited commercial resource. The display area, the height and width of the package, is what the buyers are readily able to see. Therefore, compact sellers desire to minimize the display area necessary to show their packages. Thus, compact sellers desire to minimize the height and width of their packages so as to maximize the number of packages which can be seen by the buyers.

In order to appropriately display a compact, the makeup within the container section must be readily visible to the buyer. Color or texture of the makeup is generally extremely important to the buyer of makeup. In order to display the makeup in the compact, compact sellers generally package the compact in a generally open position, showing both the container section and lid section in a single plane (on the front side of the package). Showing both the pan portion and lid section in a single plane doubles the amount of display area required to appropriately show the compact.

Prior art techniques for decreasing the amount of display area include utilizing a compact having a 360 degree hinge, sliding hinge, or double hinge. These hinges allow the lid section and container section to be folded back over each other so that the makeup is shown on a front side of the package and the mirror is shown on the back side of the package. This prior art technique displays both the lid section and container section in two planes. 360 degree hinges, sliding hinges, and double hinges are disadvantageous because they are expensive and often require the buyer to assemble the compact for normal operation.

Thus, there is a need for an inexpensive makeup container or compact which allows the buyer to view the color of the makeup when the compact is closed. There is also a need for a compact which reduces the amount of packaging required to display the compact. There is also a need for an inexpensive compact which can be displayed in minimal amount display area and which does not require assembly by the buyer.

SUMMARY OF THE INVENTION

The present invention relates to a case, particularly a compact, for storing a cosmetic or other colored substance. The case includes a container for holding the cosmetic and a lid pivotally secured to one side of the container by a hinge. The improvement comprises a window provided in the container through which the cosmetic can be viewed when the case is in a closed position. This permits a makeup mirror to be mounted on the underside of the lid and permits an application device to be stored between the cosmetic and the lid. In a preferred form of the invention, the window is an aperture in the flat bottom surface of the container, and the makeup is stored in a transparent pan that overlies or fits into the aperture.

It is an object of the present invention to provide a compact which provides a window for viewing the color of the makeup in the compact when the compact is closed.

It is another object of the invention to provide a compact which utilizes a package requiring a minimal amount of display area.

It is yet another object of the invention to allow the compact to be packaged while showing the makeup without using a 360 degree hinge, double hinge, or sliding hinge.

It is still another object of the invention to provide a compact which does not have to be opened to show the makeup.

It is another object of the present invention to provide a compact which eliminates the need for external packaging.

Further objects and features of the invention will be apparent from the following specification and claims when considered in connection with the accompanying drawings illustrating the preferred exemplary embodiments of the present invention.

BRIEF DESCRIPTION OF THE DRAWINGS

Preferred exemplary embodiments of the invention will hereafter be described with reference to the accompanying drawings, wherein like reference numerals denote like elements, and.

DETAILED DESCRIPTION OF THE PREFERRED EXEMPLARY EMBODIMENT

Figure 1:
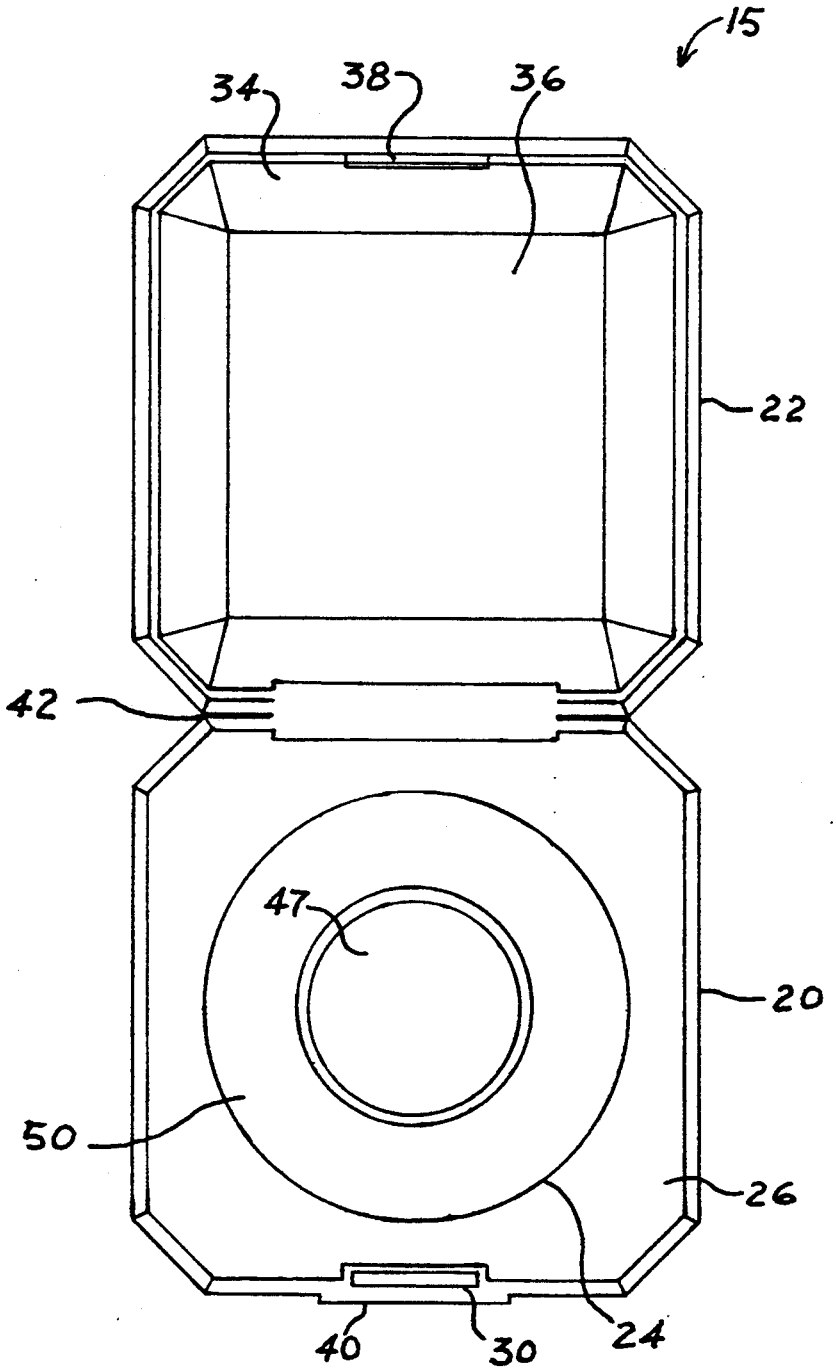
FIG. 1 is a top view of the inside of a compact in an open position according to a first embodiment of the present invention.
Figure 4:
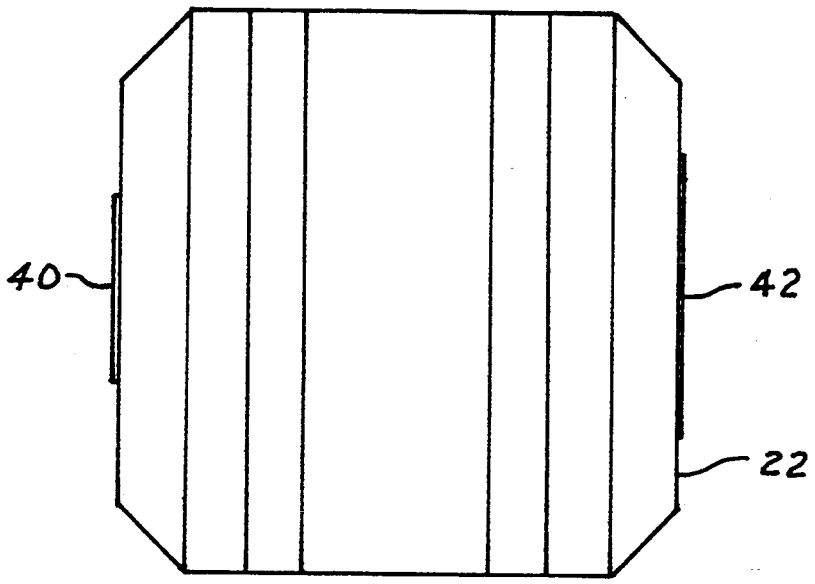
FIG. 4 is a top view of the compact illustrated in FIG. 2.

In FIG. 1, a makeup case or compact 15 of the invention includes a container 20 and a lid 22 connected to container 20 by a hinge 42. Although container 20 and lid 22 are generally square, various shapes such as circular and octagonal may be used. The components of compact 15 are generally made of plastic. Container 20 has a shallow pan 24 for holding makeup and a support insert 26 mounted thereon for supporting pan 24. Container 20 also includes a prong 30 which is integral with a conventional release mechanism 40.

Pan 24, or at least a portion thereof, is made of a transparent material such as glass, clear nylon, clear acrylonitrile-butadiene-styrene (ABS) or polycarbonate. Pan 24 as well as other components associated with compact 15 may be injection molded, vacuum-formed or thermally formed. Pan 24 is preferably circular, however, most any shape is possible.

Support insert 26 preferably provides a central cavity 50 that holds pan 24 in the proper position in container 20. Support insert 26 is preferably friction-fitted, glued, snap-fitted, or otherwise attached to the inside surface of container 20.

Lid 22 includes a catch 38 and a beveled frame 34A that retains a mirror 36. Frame 34A is preferably attached to the inside of lid 22 by glue, a friction-fit, snap-fit, or double-stick pads. Catch 38 engages prong 30 to lock compact 15 in a closed position. Release mechanism 40 may be pushed to open compact 15.

Hinge 42 unites container 20 and lid 22. Hinge 42 preferably limits rotation of lid 22 to 180 degrees, i.e., to the flat, open position shown in FIG. 1. Hinge 42 is preferably a metal pin hinge, snap hinge, or a living hinge as in the embodiment shown.

Figure 2:
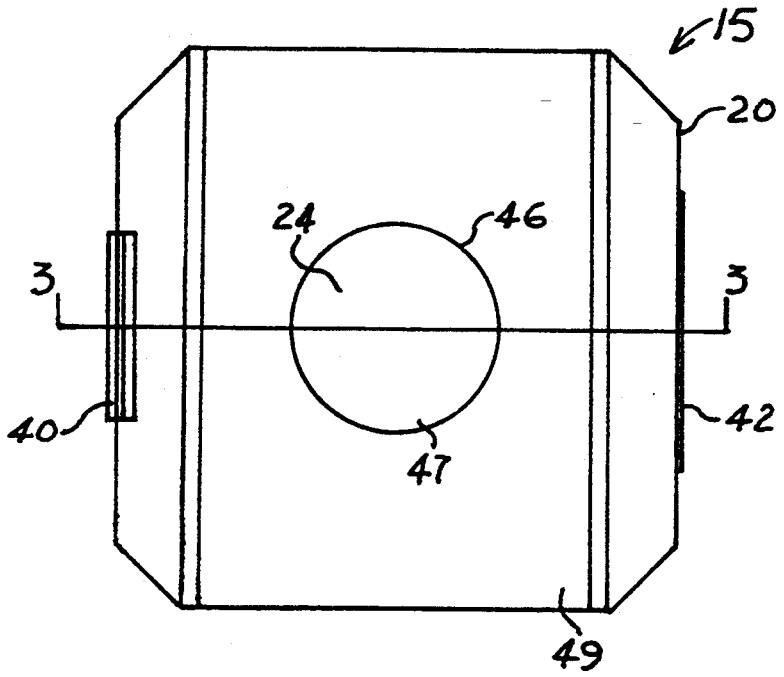
FIG. 2 is a bottom view of the compact illustrated in FIG. 1 in a closed position.

As shown in FIG. 2, container 20 has a central, circular aperture 46 on its bottom 49. Aperture 46 may be located anywhere on the bottom of container 20 so long as the makeup in pan 24 is visible through aperture 46, and may likewise be of any convenient shape. In this embodiment, aperture 46 receives a transparent indentation 47 of pan 24 which fits into and fills aperture 46. Other portions of pan 24 may be opaque if indentation 47 is transparent. The outside of indentation 47 is preferably flush with the bottom 49 of container 20. Indentation 47 and aperture 46 provide a window in which the makeup is visible from its underside when compact 15 is closed.

Figure 3:
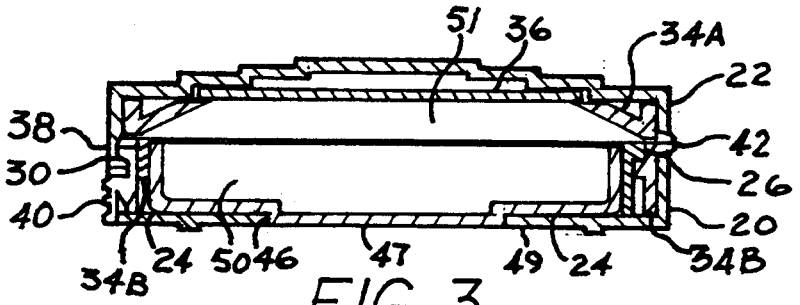
FIG. 3 is a sectional view along line 3—3 in FIG. 2.

As shown in FIG. 3, a conventional plastic frame 34B which is integral with mechanism 40, hinge 42 and beveled frame 34A underlies and supports insert 26. Generally, a visually obstructing object such as a makeup pad (not shown), screen or applicator, is stored in a space 51 between mirror 36 and the makeup in pan 24. Makeup includes but is not limited to lipstick, eye shadow, powder, cream, lotion, or any other cosmetic.

Figure 5:
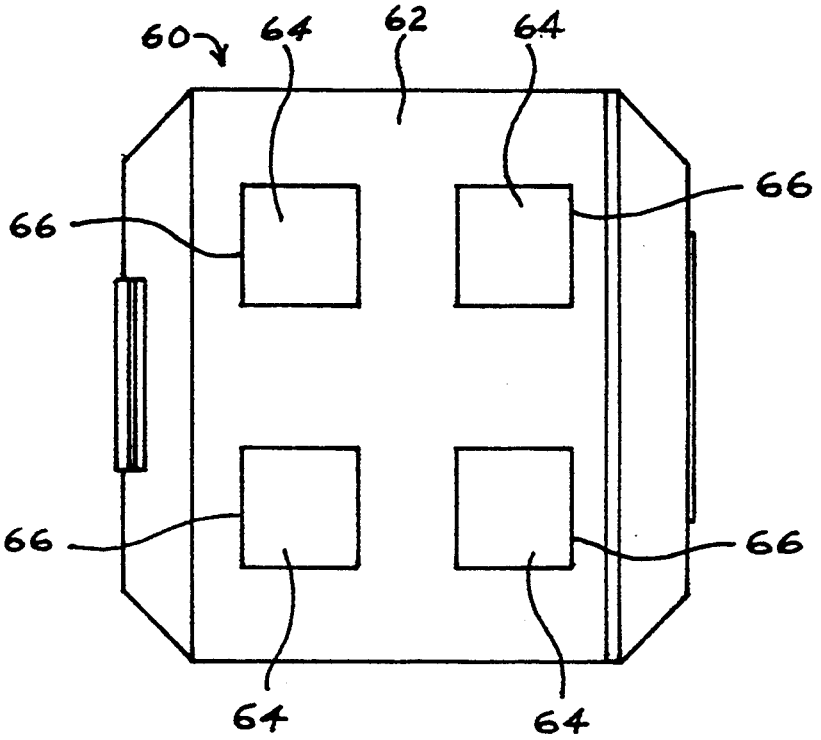
FIG. 5 is a bottom view of a second embodiment of the invention.

FIG. 5 illustrates an alternate embodiment of a compact 60 wherein a transparent makeup pan 62 has several square indentations 64 which act as wells for different colors of makeup. Indentations 64 are each visible through corresponding spaced apertures 66. Alternatively, transparent makeup pan 62 having square indentations 64 may be replaced by multiple pans each having at least a transparent portion.

Figure 6:
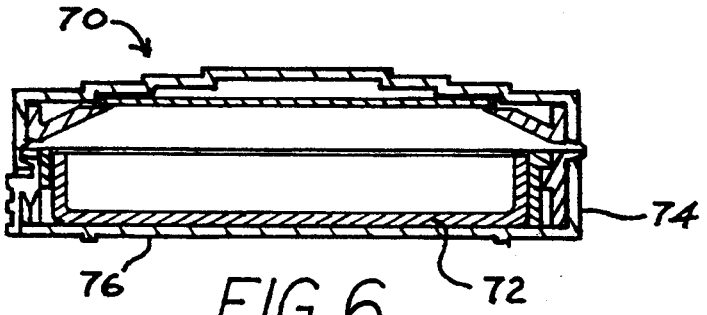
FIG. 6 is a cross-sectional view of a third embodiment of the invention.

FIG. 6 shows a further alternative embodiment of a compact 70 wherein a transparent makeup pan 72 lacks indentations. A central window 76 of container 74 is made of a transparent material, so that makeup within pan 72 is visible through both window 76 and pan 72. The arrangement shown may be further modified by, for example, making a container 74 entirely of a transparent plastic, or by leaving window 76 open, in which case the bottom of the pan 72 would not be flush with the outside of container 74.

Figure 7:
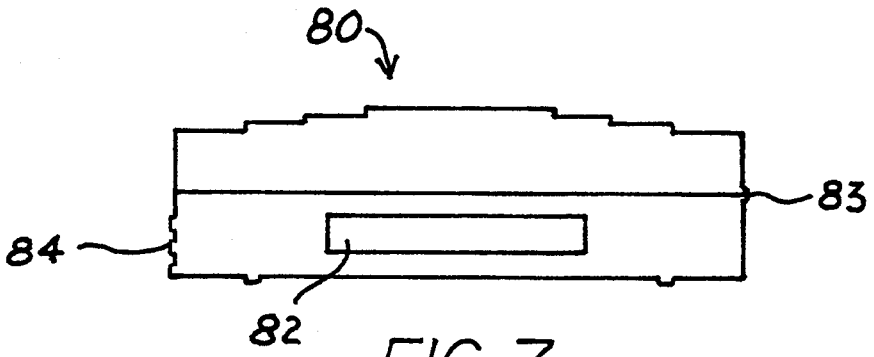
FIG. 7 is a side view of a fourth embodiment of the invention.

FIG. 7 shows an embodiment of a compact 80 substantially the same as shown in FIG. 6, except that a window 82 is provided in the side of the container rather than the bottom. This is less preferred insofar as it makes it more difficult to see the contents of the compact. Preferably, window 82 is located away from a hinge 83 and release mechanism 84 so that window 82 provides an aesthetically pleasing view of the makeup in the container.

Figure 8:
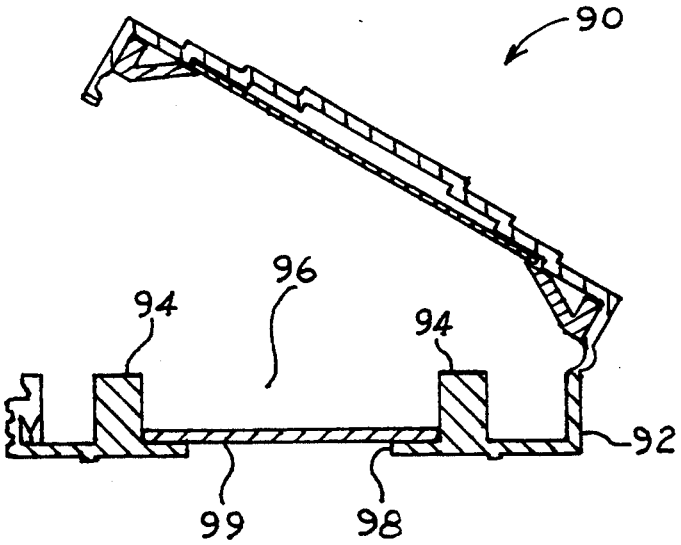
FIG. 8 is a cross sectional view of a fifth embodiment of the invention in a partly open position.

FIG. 8 shows alternative embodiment of a compact 90 which does not include a transparent makeup pan. An integrally formed upright wall 94 in a container 92 defines a cavity 96 for storing makeup. Container 92 includes an aperture 98 which is covered by a transparent plate 99. Transparent plate 99 is glued or otherwise attached to container 92 at the edge of bottom wall of cavity 96 to prevent makeup from leaking out of container 92 through aperture 98. Transparent plate 99 and aperture 98 are not necessary if container 92 is a transparent piece having cavity 96 integrally formed therein.

It is to be understood that, while the detailed drawings and specific examples given describe preferred exemplary embodiments of the present invention, they are for the purpose of illustration only. The present invention is not limited to the precise details and conditions disclosed. For example, although clear ABS is suggested for pan 24, various materials may be used. Further, the hinge may be eliminated, for example, in a compact that has a screw top lid which engages a threaded container or other assemblies such as snap-on or press-on lids. The case of the invention may also be used for storing colored items or substances other than cosmetics for which it may be undesirable or impractical to provide a clear lid.

I claim:

1. A case for storing a cosmetic or other colored substance, including a container for holding the cosmetic and a lid securable to the container, the lid having a mirror secured to its underside, the improvement which comprises:

a window provided in the container through which the cosmetic can be viewed when the case is in a closed position; and a pan insertable into the container, in which pan the cosmetic is stored, at least a portion of the pan being made of a transparent material which is viewable through the window.

2. The case of claim 1, wherein the pan is plastic.

3. The case of claim 1, wherein the window is located on a bottom surface of the container.

4. The case of claim 3, wherein the window comprises an aperture in the container.

5. The case of claim 1, wherein the window comprises a portion of the container made of a transparent material.

6. The case of claim 4, wherein the transparent portion of the pan comprises an indentation configured to fit into and fill the aperture.

7. The case of claim 1, further comprising a hinge that pivotally secures the lid to the container.

8. The case of claim 1, wherein the container has means forming a cavity for storing makeup therein.

9. The case of claim 8, wherein the means for storing is a support insert.

10. The case of claim 8, wherein the means for storing is an upright wall.

11. The case of claim 2, wherein the container has means forming a cavity for storing makeup therein, and wherein the pan fits into the cavity.

12. A case for storing a cosmetic or other colored substance, comprising:

a lid;

a pan for holding the cosmetic, at least a portion of the pan being made of a transparent material;

a container having a cavity and an aperture, the aperture provided in the container through which the transparent material is viewable, the pan fitting in the cavity; and a hinge that pivotally secures the lid to the container.

13. A case for storing a cosmetic or other colored substance, including a container for holding the cosmetic, a lid secured to the container, and a visually obstructing object, the container and lid defining a space between the cosmetic and the lid, the visually obstructing object being stored in the space, the improvement which comprises:

a see-through portion through which the cosmetic can be viewed when the case is in a closed position; and a pan insertable into the container, the pan having a first face for storing the cosmetic and a second face disposed towards the see-through portion, the pan having a viewing site located proximate the see-through portion, the second face being disposed towards the see-through portions, the first face being disposed toward the visually obstructing object, the cosmetic being viewable through the viewing site, when the case is in the closed position.

14. The case of claim 13, wherein the visually obstructing object is a mirror located on an underside of the lid.

15. The case of claim 13, wherein at least a portion of the pan being made of a transparent material which is viewable through the see-through portion.

16. The case of claim 13, wherein the container is made of a transparent material, and the see-through portion is a bottom surface of the container.

17. The case of claim 15, wherein the see-through portion is located on the bottom surface of the container.

18. The case of claim 13, wherein the see-through portion comprises a plastic transparent material.

19. The case of claim 17, wherein the see-through portion is an aperture in the container and including a transparent section of the pan comprises an indentation configured to fit into and fill the aperture.

20. The case of claim 13, further comprising a hinge that pivotally secures the lid to the container.

21. The case of claim 13, wherein the container has means forming a cavity for storing makeup therein.

22. The case of claim 21, wherein the means for storing is a support insert.

23. The case of claim 21, wherein the means for storing is an upright wall.

24. The case of claim 13, wherein the container has means forming a cavity for storing makeup therein, and wherein the pan fits into the cavity.

* * * * *

UNITED STATES PATENT AND TRADEMARK OFFICE

CERTIFICATE OF CORRECTION

PATENT NO. : 5,431,177
DATED : July 11, 1995
INVENTOR(S) : Michael M. Kecman

It is certified that error appears in the above-identified patent and that said Letters Patent is hereby corrected as shown below:

Column 5,
Line 35, delete “portions” and substitute -- portion --.

Signed and Sealed this

Eleventh Day of November, 2003

JAMES E. ROGAN
*Director of the United States Patent and Trademark Office*